US005553597A

United States Patent [19]

Sparks

[11] Patent Number: 5,553,597

[45] Date of Patent: Sep. 10, 1996

[54] OVERDRAW FOR A COMPOUND BOW

[76] Inventor: Rodney L. Sparks, 113 Jolomic La., Georgetown, Ky. 40324

[21] Appl. No.: 366,175

[22] Filed: Dec. 29, 1994

[51] Int. Cl.[6] ..... F41B 5/22

[52] U.S. Cl. ..... 124/44.5; 124/25.6; 124/86

[58] Field of Search ..... 124/23.1, 24.1, 124/25.6, 44.5, 86, 88

[56] References Cited

U.S. PATENT DOCUMENTS

| | | | |
|---|---|---|---|
| 2,926,650 | 3/1960 | Irwin | 124/24.1 |
| 4,027,645 | 6/1977 | Damron | 124/24.1 |
| 4,696,281 | 9/1987 | Nishioka | 124/25 |
| 4,708,341 | 11/1987 | Paraskevakos | 124/24.1 X |
| 4,827,893 | 5/1989 | Nishioka | 124/25 |
| 4,829,974 | 5/1989 | Anderson | 124/24.1 |
| 4,860,719 | 8/1989 | Scheiterlein | 124/25 |
| 4,879,988 | 11/1989 | Larson | 124/44.5 |
| 5,022,378 | 6/1991 | Rhodehouse et al. | 124/44.5 |
| 5,140,972 | 8/1992 | Fisk | 124/44.5 |
| 5,146,908 | 9/1992 | Larson | 124/88 |
| 5,205,267 | 4/1993 | Burdick | 124/24.1 |
| 5,261,383 | 11/1993 | Halamay | 124/44.5 |
| 5,263,465 | 11/1993 | Anderson | 124/24.1 |
| 5,327,877 | 7/1994 | Shaw, III | 124/24.1 |

*Primary Examiner*—John A. Ricci
*Attorney, Agent, or Firm*—King and Schickli

[57] ABSTRACT

An overdraw apparatus for a compound bow includes a frame that is mounted to the body of the compound bow, a guideway carried on the frame, an arrow rest carriage received for sliding movement on the guideway and a mechanism for connecting the arrow rest carriage to a tension cable system of the compound bow. The arrow rest carriage is displaceable between a rest position and a fully drawn position through the connection of the carriage to the tension cable system as the drawstring of the bow is drawn back to shoot an arrow.

19 Claims, 2 Drawing Sheets

OVERDRAW FOR A COMPOUND BOW

TECHNICAL FIELD

The present invention relates generally to archery equipment and, more particularly, to an overdraw apparatus for a compound bow.

BACKGROUND OF THE INVENTION

Archery has long been enjoyed by a select segment of sports enthusiasts and in the past two or three decades the popularity of bow hunting and target shooting has grown at unprecedented rates. As a result of this increase in interest, new equipment is developed and introduced regularly. One such development, the compound bow, is widely used and preferred by bow hunters and target shooters alike.

As is known, the compound bow has a bow body including a riser and two opposing limbs. Mechanical advantage is afforded by a continuous tension cable system connected to and passing between two eccentric cams rotatably mounted to the ends of the limbs. The interaction of the tension cable system with the cams during drawing of the drawstring provides the multiplication of force. In affect the action of the eccentric cams advantageously provides reduction in the force required to draw the drawstring during approximately the last half of the draw. This allows the archer to maintain the full draw with reduced effort. As a result, the archer is better able to concentrate on aiming. Further, since less effort is required to maintain the drawstring in the fully drawn position, there is less strain on the muscles of the archer and it is possible to maintain a steadier hand for more accurate shooting.

Yet an additional advantage to compound bows is that an archer is typically able to use a more powerful bow with a stronger pull force. Such a bow is able to propel an arrow with a faster flight accompanied by a flatter trajectory to the selected target. This is especially advantageous in hunting where the prospects of a moving target and the need for exact placement to bring about a kill make high arrow speeds particularly desirable.

The desire for faster arrow flight and a flatter trajectory has also led many archers to utilize shorter arrows. Specifically, shorter arrows weigh less than longer arrows and as a result are able to provide these desired advantages. They are also easier to carry in the field. They may be held in a quiver mounted on the bow. They are less bulky and cumbersome and, therefore, less likely to hook, snag or catch on tree limbs and other impediments. Shorter arrows are also more rigid than long arrows and, therefore, less likely to flex significantly when propelled by the drawstring. In certain situations arrow flexing may cause the arrow to kick off the arrow rest leading to inaccurate shooting. This problem is minimized with shorter arrows.

Despite all there advantages, shorter arrows do, however, have one major drawback. Specifically, when shooting an arrow from a bow, accuracy is only possible if the front portion of the arrow nests in an arrow rest. Such an arrow rest is an integral portion of the bow riser. Accordingly, it should be appreciated that longer arrows allow a longer draw of the drawstring while still maintaining proper contact with the arrow rest (e.g. a 32 inch long arrow provides for 2 more inches of draw than a 30 inch long arrow). Of course, an archer cannot gain the full advantage provided by shorter arrows unless it is possible to maintain a full draw of the bowstring and, accordingly full power, to shoot the shorter arrow. Toward this end, a number of overdraw apparatus have been previously provided in the art.

Specifically, an overdraw apparatus provides a stationary arrow rest that is positioned so as to project rearwardly from the riser toward the drawstring. Such devices partially bridge the gap between the arrow rest on the riser and the drawstring and, therefore, support the front end of shorter arrows while still allowing for full draw. Hence, the full advantages of the increased power of the compound bow and the lighter weight of the shorter arrows are both being enjoyed by the archer.

Of course, in order to provide the maximum benefit the overdraw must extend rearwardly from the riser a sufficient distance to support the front portion of the arrow when the drawstring is in the fully drawn position. The shorter the length of the arrow utilized, the further the arrow rest of the overdraw must extend rearwardly. In extreme situations, the overdraw may interfere with and/or engage the tension cable or the drawstring upon release of the drawstring when shooting an arrow. This interference may lead to excessive wear of or damage to these components thereby requiring replacement more often than is otherwise desired. In hunting, the resulting impact of the drawstring against the overdraw may also produce a significant noise that might frighten the prey causing them to flee.

Recognizing this shortcoming of overdraws with stationary arrow rest platforms, several overdraws with sliding arrow rests have previously been developed in the art. Examples of these are disclosed in U.S. Pat. Nos. 5,140,972 to Fisk and 5,205,267 to Burdick. In Fisk a reciprocating arrow rest carriage is biased in a forward direction toward the riser by a spring and pulled in a rearward direction when drawing the drawstring via connection of the carriage to the tension cables by a tether and block. In Burdick, the rearward movement of the arrow rest carriage is provided by tethering the carriage to the drawstring. Again, a tension spring provides forward biasing of the arrow rest carriage.

While the overdraw designs disclosed in Fisk and Burdick function as intended, they are not without their disadvantages. Both the biasing spring and tethers are components that are prone to wear and either may break in service, effectively preventing further use of the bow until fully repaired. A tether is also a nuisance during hunting as it tends to catch on tree limbs and other projecting obstacles encountered in the field. Further, the overdraw device disclosed in Fisk and Burdick are unduly complicated and are simply just not desirable for use in the field. A need is therefore identified for an improved overdraw apparatus.

SUMMARY OF THE INVENTION

Accordingly, it is a primary object of the present invention to provide an overdraw apparatus for a compound bow overcoming the above-described limitations and disadvantages of the prior art.

Yet another object of the present invention is to provide an overdraw apparatus of simple, lightweight and inexpensive construction that provides smooth and reliable operation at all times.

Another object of the present invention is to provide an overdraw apparatus with a sliding arrow rest carriage that may be finely adjusted, both vertically and horizontally to provide a true center flight for the arrow depending upon the diameter of the arrow being utilized.

Still another object is to provide an overdraw apparatus including an arrow rest carriage that is positively displaced in a smooth and reliable manner to a fully drawn position when drawing the drawstring to shoot an arrow and that is positively moved forward to provide clearance for the drawstring upon release. Advantageously, this is done without the use of a troublesome tether through means of an integral, direct connection of the arrow rest carriage with the tension cables. Advantageously, this connection also holds the tension cables in a slightly offset position from the plane including the arrow rest and drawstring. Accordingly, there is no need to equip the compound bow with an offset rod for the purpose of providing the necessary clearance to receive an arrow. This results in important weight savings that are appreciated in the field.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved overdraw apparatus is provided for a compound bow. As is known such a compound bow includes a bow body, a drawstring and a tension cable system. The overdraw apparatus includes a frame that may be mounted to the bow body by means of one or more fasteners such as bolts or screws. A guideway is carried on this frame. Preferably, the guideway includes a pair of spaced, parallel elongated rods.

An arrow rest carriage is received for sliding movement along this guideway and is displaceable between a rest position and a fully drawn position wherein the arrow is ready for shooting. Additionally, the overdraw apparatus includes a means for connecting the arrow rest carriage directly to the tension cable system of the compound bow. As a result, the arrow rest carriage is displaced along the guideway rearwardly from the bow body as the drawstring is drawn back to shoot an arrow. Additionally, the tension cable system is advantageously offset from the plane of movement of the drawstring toward and away from the arrow rest thereby providing the necessary clearance to allow the proper positioning of an arrow for shooting. No additional offset rod or other device need be provided for this purpose.

More specifically describing this invention, the arrow rest carriage includes a slide block having a pair of spaced apertures for receiving the rods of the guideway and an extension arm connected to the slide block for supporting the arrow rest. Further, the means for connecting the arrow rest carriage to the tension cable system includes a clip, preferably made of nylon or polytetrafluoroethylene, for engaging the tension cable system and a securing bracket for securing the clip to the arrow rest carriage. Still more specifically, screw fasteners may be utilized to secure the bracket to the slide block of the arrow rest carriage.

In addition, a stop may be mounted to the frame for engaging and limiting the forward sliding movement of the arrow rest carriage along the guideway upon shooting an arrow. Preferably, the stop comprises a resilient bumper mounted on the end of a spring loaded piston longitudinally aligned between the spaced, parallel rods of the guideway. In this manner the force of the blow is cushioned as the forward thrust of the carriage is brought to a stop prior to the recoil of the tension cables and, therefore, the carriage to the rest positioned.

In accordance with yet another aspect of the present invention, the arrow rest may be adjusted to provide a true center flight for the arrow. Thus, the arrow rest may be adjusted or customized to shoot different diameter arrows with the utmost precision. More specifically, the arrow rest includes a pair of nylon or polytetrafluoroethylene tipped plungers converging at an included angle of approximately 60° with each plunger forming an approximately 30° angle relative to the vertical. The plungers include threaded mounting posts that allow their relative height to be adjusted and, therefore, provide vertical center flight adjustment. The plungers also smooth operation by absorbing any shock as the arrow is accelerated toward the target by the kinetic energy being released through the drawstring. In this way, accuracy is maximized.

Further, the extension arm includes a mounting channel for engaging the slide block and an adjusting screw for holding the slide block and extension arm together. The adjusting screw extends through an elongated slot in the extension arm. Accordingly, by loosening the screw it is possible to extend the arm out from or retract the arm toward the frame 12. Once horizontal center is achieved, the adjusting screw is tightened to maintain the desired geometry.

Thus, it should be appreciated that by simply adjusting the position of the threaded mounting posts of the arrow rest plungers and the position of the extension arm relative to the slide block, it is possible to vertically and horizontally fine tune the arrow rest to receive arrows of different diameter which may then be held in desired true center flight position for greatest shooting accuracy.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
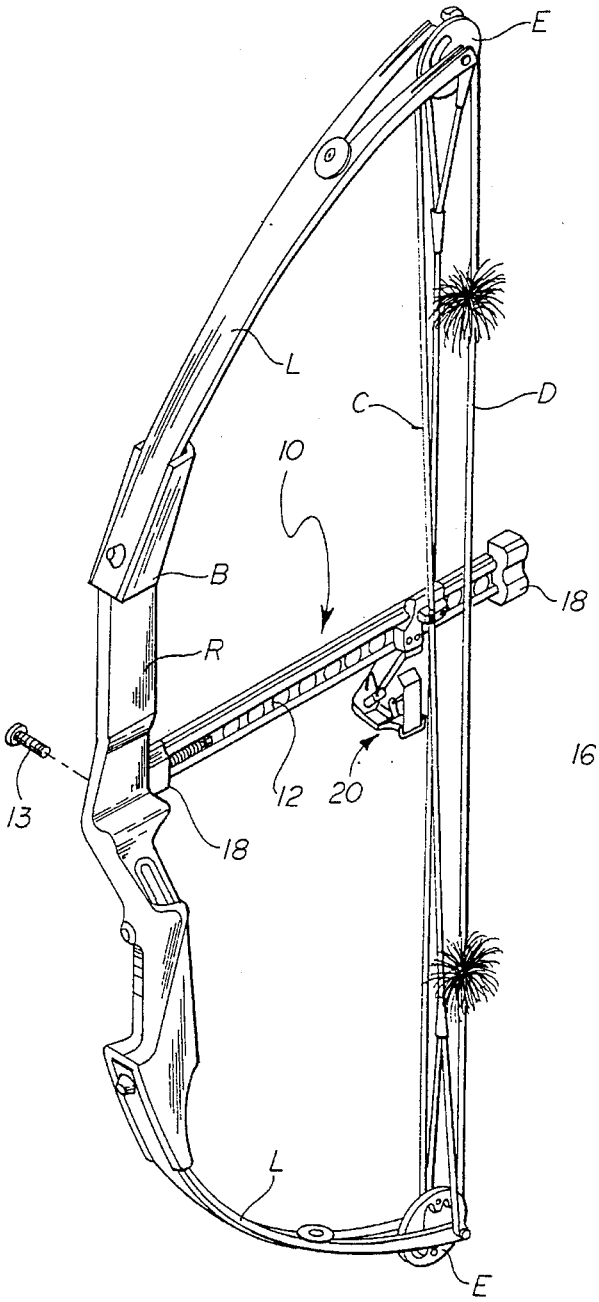
FIG. 1 is a perspective view of a compound bow incorporating the overdraw apparatus of the present invention.

Reference is now made to FIG. 1 showing a compound bow B incorporating the overdraw apparatus 10 of the present invention that advantageously allows an archer to receive the full benefit of utilizing shorter arrows of lighter weight while simultaneously allowing the bow to be fully drawn for application of full power to each shot. As a result the arrow is propelled faster over a flatter trajectory thereby allowing more accurate shooting over a broader range spectrum. The apparatus 10 is preferably constructed from lightweight and weather resistant materials such as T-6 aluminum, stainless steel and brass. Thus, it provides reliable operation in the field in substantially any weather conditions while requiring only a minimal amount of maintenance.

As shown in FIG. 1, and generally known in the art, the compound bow B includes a bow body having a riser R and two opposing limbs L. A pair of eccentric cams E are rotatably mounted at the ends of the limbs L. A tension cable system C and drawstring D are strung between the eccentric cams E and in combination provide the desired mechanical advantage characteristic of a compound bow B. As shown in FIG. 1, the tension cable system C is actually comprised of two separate cable runs, a first securely attached to the top end of the bow continues downwardly and extends around the lower eccentric cam E to which it is fixed at the other end. The other cable run is securely attached to the lower end of the bow and extends upwardly around the upper eccentric cam C to which it is also attached at the opposite end.

As shown in FIG. 1, the overdraw apparatus 10 is mounted to the riser R of the bow B by means of one or more mounting bolts or other fasteners 13 that engage in cooperating threaded slots or apertures in the riser. As is known in the art, the riser R may actually include a channel contoured (not shown) to match the outline of the frame 12 of the overdraw apparatus 10 for greater mounting security and rigidity.

As shown, the elongated frame 12 extends rearwardly from the riser R. A guideway generally shown by reference numeral 14 is carried on the frame 12. The guideway 14 comprises a pair of spaced, parallel and elongated rods 16 received in cooperating mounting apertures in opposing end blocks 18. An arrow rest carriage 20 is received for sliding movement along the guideway 14. As will be described in greater detail below the arrow rest carriage 20 is displaceable between a rest position shown in FIG. 2 and a fully drawn position shown in FIG. 3. More particularly, the arrow rest carriage 20 includes a slide block 22 including a pair of captured bearings (not shown) for receiving and smoothly sliding along the rods 16. Additionally, the carriage 20 includes an extension arm 24 that supports an arrow rest generally designated by reference numeral 26.

More particularly, arrow rest 26 comprises a pair of upwardly extending and converging spring loaded plungers 28. Preferably, the plungers include tips 30 made from a relatively hard, low friction material such as nylon or polytetrafluoroethylene (e.g. DELRIN or TEFLON). The tips 30 engage and support an arrow shaft in a true center flight position so as to optimize shooting accuracy. Further, it should be appreciated that because the tips 30 are constructed from low friction material, the tips minimize the drag on the arrow as it shot from the bow. Thus, the tips 30 serve to provide the fastest possible arrow flight at the flattest possible trajectory. Both of these are important considerations particularly when hunting game.

As should be appreciated, arrows not only come in different lengths but also different diameters. Advantageously, the arrow rest 26 of the present invention allows the archer to adjust the position of the tips 30 so that arrows of different diameter may all be supported in a true center flight position relative to arrow rest 26, the string nock N on the drawstring D and the sight (not shown) so as to provide the proper relative geometry for accurate shooting.

More particularly, the spring loaded plungers 28 are each held in threaded mounting posts 32. The threaded mounting posts 32 are engaged in cooperating threaded apertures 34 in the extension arm 24. Accordingly, by twisting the mounting posts 32 it is possible to adjust the relative length of the plungers 28: that is, extend or retract the tips 30 from the extension arm 24. Thus, in order for the tips 30 to support a relatively small diameter arrow along the true center flight axis defined by the vertical line of the cross hairs H, the posts 32 are turned counterclockwise so that the tips 30 project further from the extension arm 24. Conversely, in order to support a relatively wide diameter arrow along the true center flight axis, the posts 32 are turned clockwise so that the tips 30 do not project as far above the extension arm 24. Once the posts 32 are properly adjusted, set screws 36 may be tightened to secure the posts in position.

A true center flight adjustment along the horizontal axis of the cross hairs H is also possible. More specifically, the extension arm 24 includes a channel 25 that receives the distal end 27 of the slide block 22 (see FIGS. 2, 3 and 6). An adjustment screw 29 secures the extension arm 24 to the slide block 22. The screw 29 extends through an elongated slot 31 in the arm 24 that allows the horizontal position of the arm relative to the slide block 22 to be adjusted.

Figure 4:
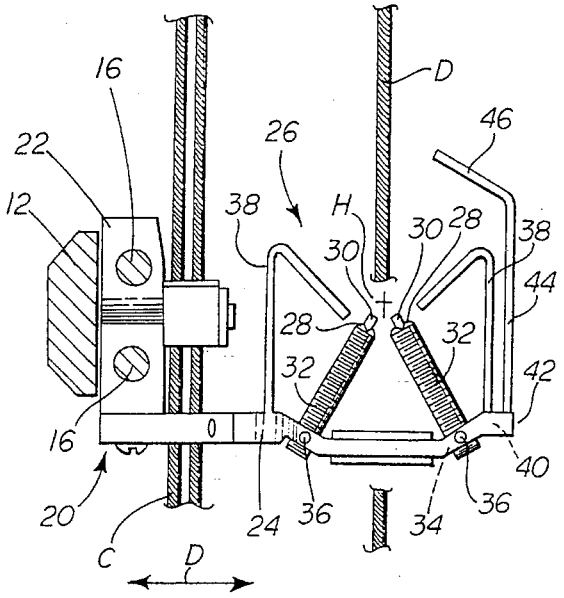
FIG. 4 is a front elevational view providing a detailed showing of the arrow rest carriage and particularly the arrow rest features allowing center flight adjustment.
Figure 5:
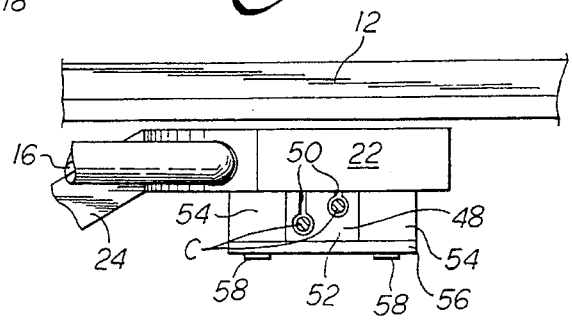
FIG. 5 is a fragmentary top plan view showing the connection of the arrow rest carriage to the tension cable system.
Figure 6:
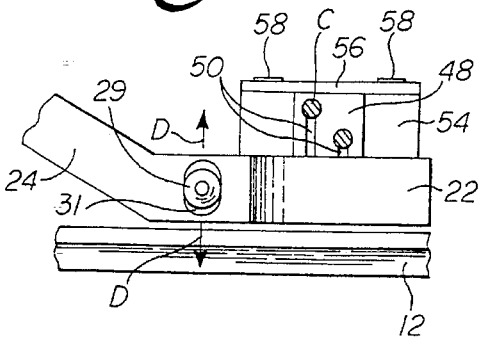
FIG. 6 is a fragmentary bottom plan view showing the adjustment screw for adjusting the horizontal center flight of an arrow.

More specifically, the screw 29 is loosened and the arm 24 is adjusted by sliding in or out along the slide block as necessary (see action arrows D in FIGS. 4 and 6). The engagement of the distal end or shoulder 27 of the slide block 22 in the channel 25 of the arm 24 insures that the proper orientation of the arm is maintained at all times during adjustment. Once the proper horizontal geometry is established between the drawstring D and the arrow rest 26 to prevent the arrow from kicking either right or left, the screw 29 is tightened. This secures the arm 24 relative to the block 22 for subsequent shooting.

As should be further appreciated from reviewing FIG. 4, a pair of substantially check-shaped safety bars 38 are mounted to the extension arm 24. More specifically, the proximal end of the safety bars 38 are received in cooperating apertures 40 in the extension arm 24. The relative height of the safety bars 38 is adjusted by sliding the safety bars in and out of the apertures 40 until such time as the upper surface of the safety bars are substantially aligned with the distal end of the tips 30. Set screw 42 are then utilized to secure the safety bars 38 in position in the extension arm 24. As should be appreciated, the safety bars 38 function to form a substantially v-shaped feeding slot that serves to cradle and guide the arrow into its proper seated position on the tips 30 of the arrow rest 26. This is a particularly convenient feature for the archer as it helps maintain the arrow in the proper position as the bow B is manipulated and the drawstring D is drawn back for shooting.

In addition, an upwardly extending safety plate 44 including an inwardly projecting lip 46 is mounted to the distal end of the extension arm 24. This safety plate 44 restricts the movement of the arrow, effectively preventing the arrow from falling over the top of the safety bar 38 toward the outside of the overdraw apparatus 10.

Reference will now be made to the operation of the overdraw apparatus 10 of the present invention during the shooting of an arrow. First an arrow is properly positioned for shooting. Specifically, the shaft of the arrow (not shown) is positioned so as to rest on the tips 30 of the arrow rest 26 while the arrow nock is positioned against the string nock N so as to receive the drawstring D. During this initial stage the overdraw apparatus 10 is in the rest position shown in FIG. 2.

Once the arrow is properly positioned, the archer draws the drawstring D back to the fully drawn position and takes aim. As this is done, the limbs L of the bow B flex rearwardly toward the archer. As this occurs, the ends of the limbs L and, therefore, the tension cable system C also move rearwardly (note, action arrow A in FIG. 3). As the tension cable system C moves rearwardly, the carriage 20 and the arrow rest 26 supported thereon also move rearwardly along the guideway 14 to the fully drawn position shown in FIG. 3.

More particularly, this rearward movement is the result of the direct and positive connection between the carriage 20 and the tension cable system C. More particularly, a clip 48 of low friction material such as polytetrafluoroethylene or nylon is provided for engaging the tension cable system C. In particular, the clip 48 includes a pair of u-shaped grooves 50, one groove for engaging each of two tension cables. The grooves 50 are offset as shown to prevent the cables from rubbing as the drawstring D is drawn back, thereby reducing wear and increasing service life. The clip 48 is retained to the carriage 20 by receipt in a countersunk pocket 52 formed by mounting posts 54 and overlying bracket 56. A pair of screw fasteners 58 may be utilized to secure the clip 48 in position and therefore provide the positive connection between the tension cable system C and the carriage 20.

Figure 2:
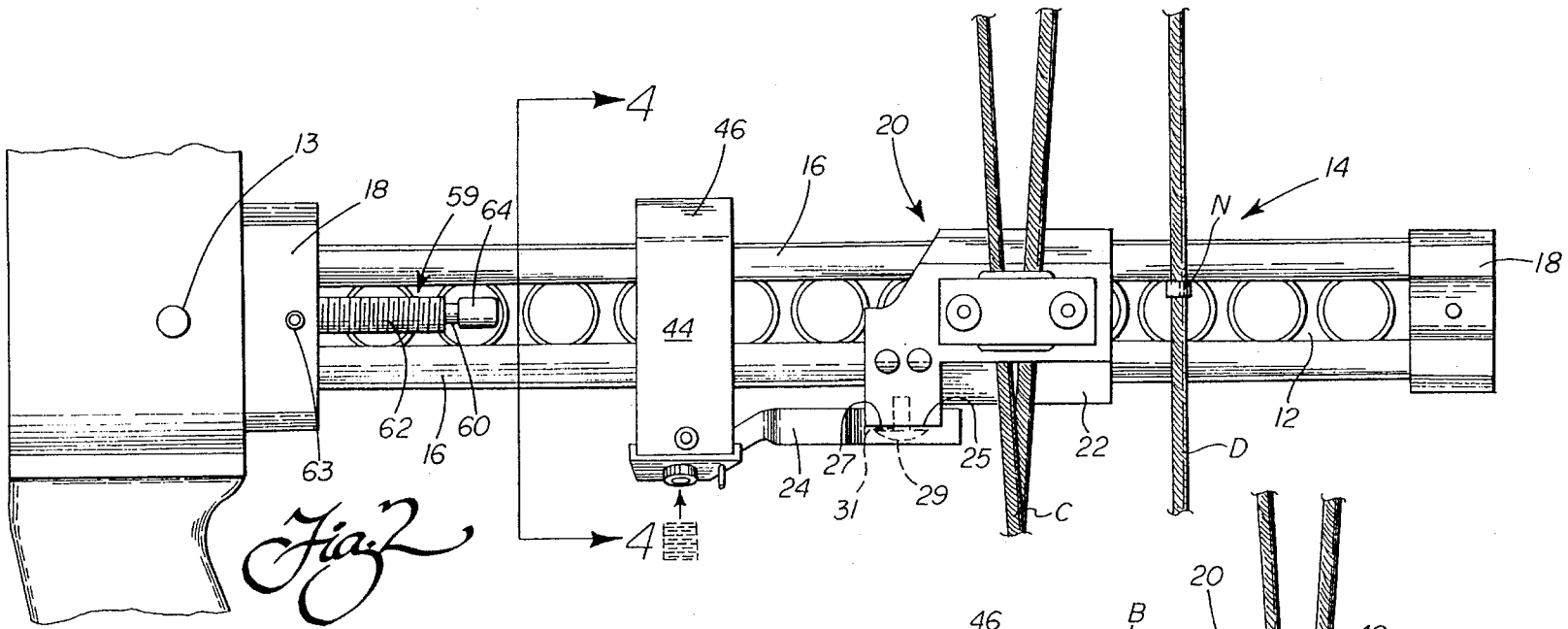
FIG. 2 is a detailed side elevational view showing the overdraw apparatus with the arrow rest carriage in the rest positioned.
Figure 3:
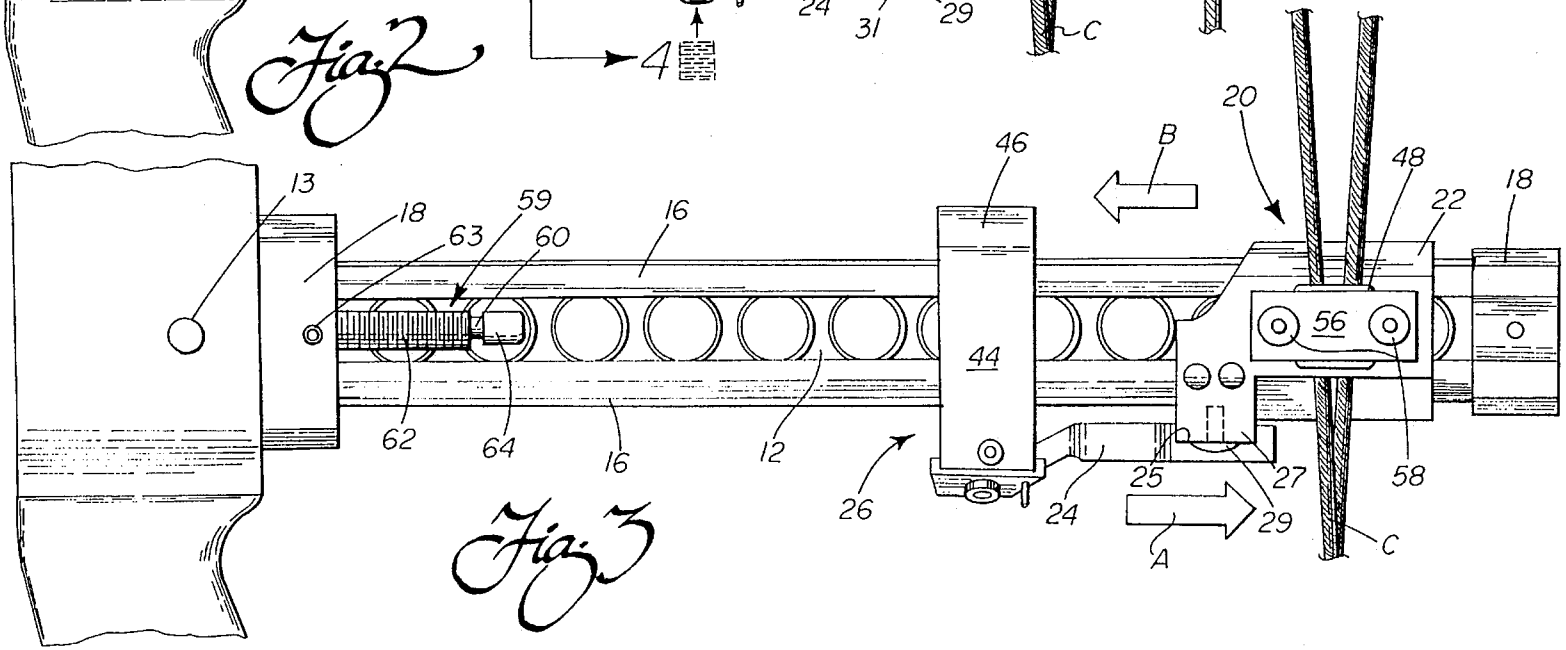
FIG. 3 is a side elevational view showing the arrow rest carriage in the fully drawn position.

Advantageously, from a review of FIGS. 2 and 3, and the description above, it should be appreciated that as the drawstring D is drawn rearwardly to the fully drawn position, the carriage 20 and therefore the arrow rest 26 including the tips 30 are also drawn rearwardly. The extent of rearward movement is approximately 2 to 3 inches. Advantageously, as a result of this rearward movement of the arrow rest 26, it should be appreciated that a relatively shorter and lighter arrow may be shot from the bow B while still enjoying the benefit of all the power provided from the fully drawn position.

As the drawstring D is released to shoot the arrow A, the limbs L return to their original preflexed positions. This results in a forward movement of the tips of the limbs L and, therefore, the tension cable system C. As the tension cable system C moves forward, the tension cables positively drive the carriage 20 and, therefore, the arrow rest 26 forward and in the direction of action arrow B shown in FIG. 3. Of course, it should be appreciated that the instantaneous application of force from the drawstring D to the arrow A at launch is cushioned and absorbed by the spring loaded plungers 28 of the arrow rest 26. To the extent that this force is absorbed and dissipated by the plungers 28, it is not transferred to the bow B and archer and, accordingly, greater shooting accuracy is thereby attained. Further, as pointed out above, the low friction tips 30 of the arrow rest 26 minimize the drag on the arrow shaft so that more energy is available to drive the arrow at the fastest possible speed along the flattest possible trajectory toward the target.

As a result, the arrow finds the desired target with greater accuracy over a wider range of distances to the target. As should further be appreciated, the forward movement of the carriage 20 and arrow rest 26 function to provide the necessary clearance to prevent engagement with the drawstring D which might otherwise cause damage or excessive wear of the drawstring and limit service life.

Further, the overdraw apparatus 10 may be provided with a stop, generally designated by reference numeral 59 for limiting the forward movement of the carriage 20. Preferably the stop 58 comprises a spring loaded piston 60 held in a threaded mounting posts 62. The threaded mounting post 62 is secured in the forward end block 18 of the frame 12 by a set screw 63 so that the piston 60 extends along a longitudinal axis parallel to and aligned between the rods 16 of the guideway 14. A bumper 64 of rubber, nylon, polytetrafluoroethylene or other appropriate material is provided on the end of the piston 60. As the carriage 20 is propelled forward by the tension cable system C, the front face of the carriage engages the bumper 64 and the piston 60 dissipates the forward force of the carriage 20 bringing it to a smoother stop from which the carriage 20 and tension cable C recoil to their rest position shown in FIG. 2.

In summary, numerous benefits result from employing the concepts of the present invention. The primary advantage relates to the ability to shoot relatively shorter arrows (that are lighter in weight and, therefore, capable of traveling faster and farther in a flatter trajectory) from the fully drawn position of the bow B so as to enjoy the benefits of the full power of the bow. This is accomplished through the provision of the arrow rest carriage 20 that slides along the guideway 14 so as to be displaceable between the rest position shown in FIG. 2 and the fully drawn position shown in FIG. 3. Advantageously, the movements of the arrow rest carriage 20 are precisely controlled by means of a direct and rigid connection to the tension cable system C so as to provide precise and reliable operation at all times. Further, this connection functions to offset the tension cable system C from alignment in the plane of movement of the drawstring D so as eliminate the need for an offset rod or other similar device required in the prior art. Advantageously, this functions to eliminate the need for this additional component and reduces the weight of the bow.

A number of additional advantages are provided as the arrow is shot from the bow. As described, the arrow rest 26 includes plungers 28 with low friction tips 30. This combination of features function to cushion the force of arrow launch and dissipate the transfer of force and vibration from the arrow into the bow that might otherwise lead to an inaccurate shot. Further, the drag on the arrow is minimized to produce the fastest and straightest arrow flight possible. A forward stop 58 functions to dissipate and cushion the forward movement of the carriage 20 so as to reduce vibration and improve feel for greater confidence. Further, the rapid forward movement of the carriage 20 under the positive drive of the tension cable system C functions to provide the necessary clearance for the drawstring D so as to prevent engagement with the extension arm 24 and the arrow rest 26 and thereby minimize wear on the drawstring.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, in order to further safeguard the integrity of the drawstring D it is also possible to fix a resilient cushion or bumper 70 to the rearwardly facing edge of the extension arm 24. Thus, in those rare situations where the drawstring does engage the arm 24 the blow is cushioned so as to prevent any damage to the drawstring.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. An overdraw apparatus for a compound bow including a bow body, drawstring and tension cable system, comprising:

a frame;

means for mounting said frame to the bow body;

a guideway carried on said frame, said guideway including a pair of spaced, parallel, elongated rods;

an arrow rest carriage received for sliding movement along said guideway and displaceable between a rest position and a fully drawn position, said arrow rest carriage including a slide block for receiving and sliding along said rods; and means for directly connecting said arrow rest carriage to the tension cable system whereby said arrow rest carriage is displaced along said guideway as the drawstring is drawn back to shoot an arrow.

2. The overdraw apparatus as set forth in claim 1, wherein said arrow rest carriage includes an extension arm connected to said slide block for supporting an arrow rest.

3. The overdraw apparatus as set forth in claim 1, wherein said connecting means includes a clip for engaging the tension cable system, a securing bracket for securing said clip to said arrow rest carriage and means for fastening said securing bracket to said slide block.

4. The overdraw apparatus as set forth in claim 3, including a stop, mounted to said frame for engaging and limiting forward sliding movement of said arrow rest carriage along said guideway upon shooting an arrow.

5. The overdraw apparatus as set forth in claim 4, wherein said stop includes (1) a spring loaded piston having a longitudinal axis extending between and parallel to said spaced, elongated rods of said guideway and (2) a resilient bumper for engaging said arrow rest carriage.

6. The overdraw apparatus as set forth in claim 5, wherein said arrow rest includes a pair of spring loaded plungers extending upwardly from said extension arm toward convergence at an included angle of substantially 60°.

7. The overdraw apparatus as set forth in claim 6, wherein said spring loaded plungers are held in threaded posts engaging cooperating threaded apertures in said extension arm.

8. The overdraw apparatus as set forth in claim 7, wherein said apparatus also includes a pair of opposed, safety bars, each safety bar being substantially check-shaped and having a proximal end secured to said extension arm and a distal end projecting toward said spring loaded plungers whereby said safety bars define a substantially v-shaped entry for feeding an arrow into position on the spring loaded plungers of said arrow rest.

9. The overdraw apparatus as set forth in claim 8, further including an upwardly extending safety plate with an inwardly projecting lip on a distal end of said extension arm.

10. The overdraw apparatus as set forth in claim 4, wherein said arrow rest includes a pair of spring loaded plungers extending upwardly from said extension arm toward convergence at an included angle of substantially 60°.

11. The overdraw apparatus as set forth in claim 10, wherein said spring loaded plungers are held in threaded posts engaging cooperating threaded apertures in said extension arm.

12. The overdraw apparatus as set forth in claim 11, wherein said apparatus also includes a pair of opposed, safety bars, each safety bar being substantially check-shaped and having a proximal end secured to said extension arm and a distal end projecting toward said spring loaded plungers whereby said safety bars define a substantially v-shaped entry for feeding an arrow into position on the spring loaded plungers of said arrow rest.

13. The overdraw apparatus as set forth in claim 12, further including an upwardly extending safety plate with an inwardly projecting lip on a distal end of said extension arm.

14. The overdraw apparatus as set forth in claim 2, wherein said connecting means includes a clip for engaging the tension cable system, a securing bracket for securing said clip to said arrow rest carriage and means for fastening said securing bracket to said slide block.

15. The overdraw apparatus as set forth in claim 14, including a stop, mounted to said frame for engaging and limiting forward sliding movement of said arrow rest carriage along said guideway upon shooting an arrow.

16. The overdraw apparatus as set forth in claim 15, wherein said stop includes (1) a spring loaded piston having a longitudinal axis extending between and parallel to said spaced, elongated rods of said guideway and (2) a resilient bumper on an end of said piston for engaging said arrow rest carriage.

17. An overdraw apparatus for a compound bow including a bow body, drawstring and tension cable system, comprising:

a frame;

means for mounting said frame to the bow body;

a guideway carried on said frame;

an arrow rest carriage received for sliding movement along said guideway and displaceable between a rest position and a fully drawn position; and means for directly connecting said arrow rest carriage to the tension cable system whereby said arrow rest carriage is displaced along said guideway as the drawstring is drawn back to shoot an arrow, said connecting means including a clip for engaging the tension cable system, a securing bracket for securing said clip to said arrow rest carriage and means for fastening said securing bracket to said arrow rest carriage.

18. The overdraw apparatus as set forth in claim 17, including a stop, mounted to said frame for engaging and limiting forward sliding movement of said arrow rest carriage along said guideway upon shooting an arrow.

19. An overdraw apparatus for a compound bow including a bow body, drawstring and tension cable system, comprising:

a frame;

means for mounting said frame to the bow body;

a guideway carried on said frame;

an arrow rest carriage received for sliding movement along said guideweay and displaceable between a rest position and a fully drawn position; and a substantially rigid means for integrally connecting said arrow rest carriage to the tension cable system whereby said arrow rest carriage is displaced along said guideway as the draw string is drawn back to shoot an arrow.

* * * * *